United States Patent [19]

Ausiello

[11] Patent Number: 4,928,656

[45] Date of Patent: May 29, 1990

[54] FUEL-INJECTION PUMP WITH VARIABLE CYLINDER CAPACITY FOR DIESEL ENGINE INJECTION SYSTEMS

[75] Inventor: Francesco Paolo Ausiello, Turin, Italy

[73] Assignee: Weber S.r.l., Turin, Italy

[21] Appl. No.: 279,209

[22] Filed: Dec. 2, 1988

[30] Foreign Application Priority Data

Dec. 9, 1987 [IT] Italy ..... 68053 A/87

[51] Int. Cl.[5] ..... F02M 39/00

[52] U.S. Cl. ..... 123/504; 123/497

[58] Field of Search ..... 123/504, 501, 497, 498, 123/499, 500

[56] References Cited

U.S. PATENT DOCUMENTS 4,249,499 2/1981 Perr ..... 123/504
4,300,509 11/1981 Schechter ..... 123/504
4,494,514 1/1985 Augostin ..... 123/504

FOREIGN PATENT DOCUMENTS 0055654 7/1982 European Pat. Off. .
2585077 1/1987 France .
660562 11/1951 United Kingdom .
902668 8/1962 United Kingdom .
912480 12/1962 United Kingdom .

*Primary Examiner*—Carl Stuart Miller

[57] ABSTRACT

A fuel-injection pump for diesel-engine injection system, comprising at least one cylinder-piston unit with an associated intake valve for the introduction of fuel delivered by an electrical supply pump, and a delivery duct. Electronic means are provided for modulating the electrical supply pump to vary the pressure of the fuel taken in by the cylinder-piston unit and consequently the bottom dead center position of the piston and hence the length of its pumping stroke.

3 Claims, 1 Drawing Sheet

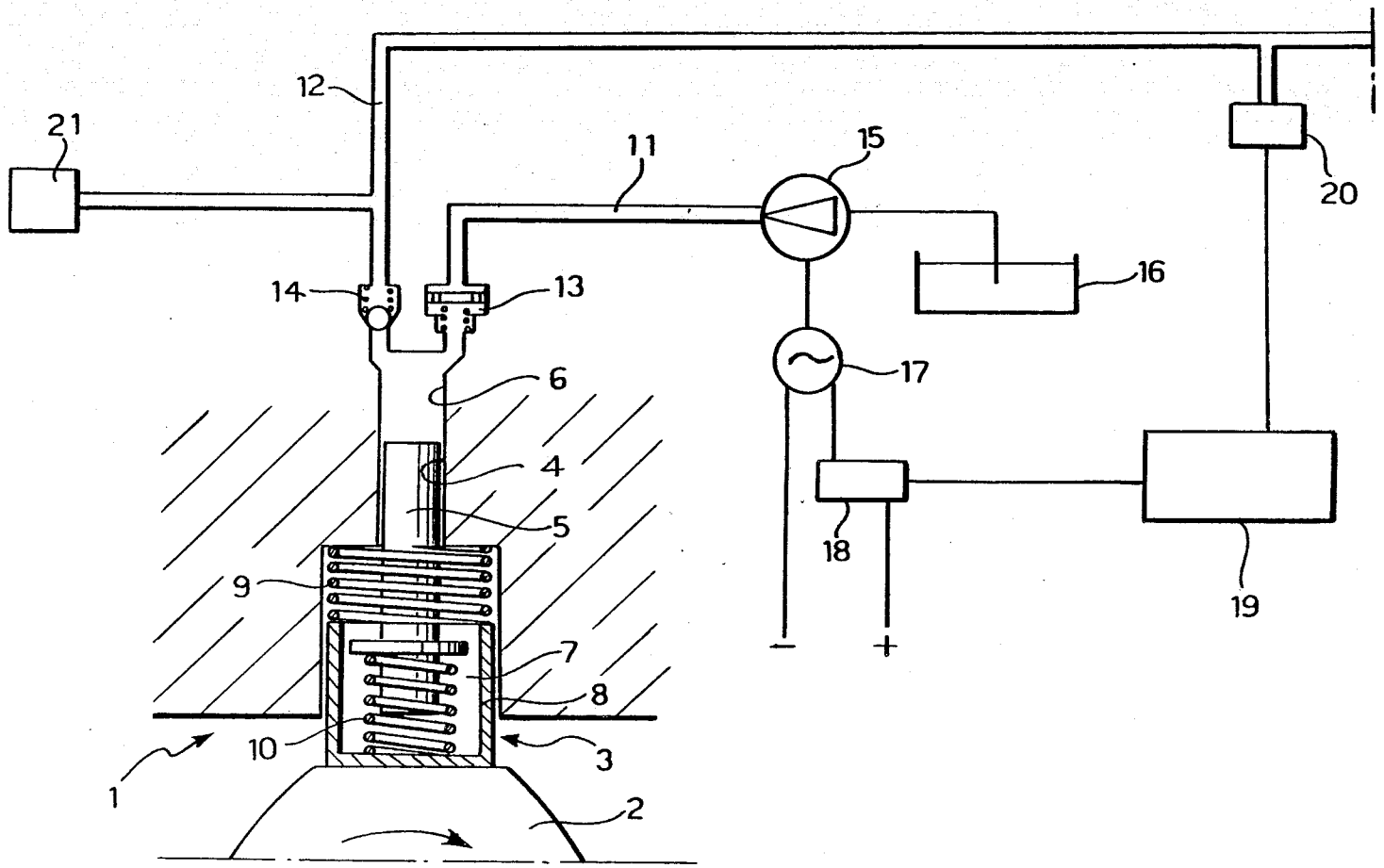
20
19
16
17
15
18
+
−
11
13
6
4
5
7
8
3
2
12
14
9
10
1
21

FUEL-INJECTION PUMP WITH VARIABLE CYLINDER CAPACITY FOR DIESEL ENGINE INJECTION SYSTEMS

The present invention relates generally to fuel-injection pumps for diesel engine injection systems.

More particularly the invention concerns an injection pump of the type comprising at least one cylinder in which a pumping piston driven by an eccentric is slidable between a bottom dead center position and a top dead center position and defines a pumping chamber in the cylinder which is connected to a fuel intake duct and to a fuel-delivery duct through an intake valve and a delivery valve respectively, and in which the electric pump is associated with the intake duct for supplying fuel from a tank to the injection pump.

The object of the present invention is to provide an injection pump of the type described above which is arranged, by simple and practical means, to supply fuel at a variable flow rate by means of the variation of its cylinder capacity.

In order to achieve this object, the subject of the invention is a fuel-injection pump of the type defined at the beginning, characterised in that equalising means are interposed between the piston and the eccentric to enable the position of the bottom dead center of the piston to be varied, and in that electronic modulation means are operatively associated with the electrical pump for varying the pressure of the fuel taken in by the pumping chamber of the injection pump and consequently the bottom dead center position of the piston and the length of its pumping stroke.

By virtue of this concept, the cylinder capacity is varied so as to vary the flow rate by means of the modification of the initial position of the piston, so varying its useful stroke, by means of the modulation of the pressure of the electrical supply pump.

This modulation is conveniently controlled by means of a microprocessor connected to a pressure sensor in the delivery duct of the pump.

The invention is applicable both to radial injection pumps and to in-line injection pumps.

The invention will now be described in detail with reference to the appended drawing, provided purely by way of non-limiting example, in which a diagram of an injection pump according to the invention with variable cylinder capacity is shown schematically.

With reference to the drawing, part of a fuel-injection pump for a diesel-engine injection system is generally indicated 1. In the embodiment illustrated, the pump 1 is of radial type and, in known manner, includes a plurality (normally three) of pumping units arranged radially around a rotor with an eccentric 2. Each of the units, only one of which is shown at 3 in the drawing, comprises a cylinder 4 in which a piston 5 driven so as to reciprocate in a straight-line by means of the eccentric 2 is slidable.

The interior of the cylinder 4 is divided by the piston 5 into an upper pumping chamber 6 and a lower chamber 7 whose base is defined by a cup-shape tappet member 8 urged against the surface of the camshaft 2 by a thrust spring 9. An equalising spring 10 is interposed between the base of the cup-shaped member 8 and the floating piston 5 and tends to keep the piston 5 in equilibrium with the pressure of the fuel supplied to the pumping chamber 6, when it is at its bottom dead center position. As will be seen below, this pressure is variable so as to allow the initial position of the piston 5 and hence its useful pumping stroke to vary.

The pumping chamber 6 is connected on the one hand to a fuel-intake duct 11 and on the other to a fuel-delivery duct 12 through an intake valve 13 and a delivery valve 14 respectively. The fuel is delivered to the intake duct 11 by means of a supply pump 15 connected to a fuel tank 16 and driven by means of an electric motor 17. This electric motor 17 is energised through a PWM modulator circuit 18 in turn controlled by means of a microprocessor 19 in dependence on the fuel pressure in the delivery duct 12. For this purpose, the microprocessor 19 is supplied by means of a pressure transducer 20 inserted in the delivery duct 12.

A pressure-control device 21, constituted by a pressure regulator, or by a calibrated maximum-pressure valve is also associated with the delivery duct 12 in conventional manner.

In operation, it is necessary for the pressure in the pumping chamber 6 always to be higher than that in the lower chamber 7. For this purpose, it suffices to keep the latter at amospheric pressure.

The microprocessor 19 regulates the operation of the electric supply pump 15-17 in dependence on the fuel-delivery conditions through pressure signals from the transducer 20 and thus modulates the pressure of the fuel taken in by the pumper chamber 6. This enables the bottom dead center position of the piston 5, that is its useful stroke, to be modified, thus varying the cylinder capacity of the pump 1 so as to achieve a variable fuel flow rate.

Naturally, the principle of the invention remaining the same, the forms of embodiment and details of construction may be varied widely with respect to those described and illustrated without thereby departing from the scope of the present invention.

Thus, for example, although the embodiment illustrated relates to a radial pump, the invention is also applicable to in-line pumps.

I claim:

1. A fuel-injected device for diesel engine injection systems, comprising:

means defining a fuel-injection pump cylinder (4);

a pumping piston (5) mounted for floating sliding movement in said cylinder between a bottom dead center position and a top dead center position, said pumping piston having one end defining a pumping chamber (6) in said cylinder, and an opposite end;

a rotatably mounted eccentric (2);

a tappet member (8) engaged with said eccentric for reciprocal movement with rotation of said eccentric;

biasing means (10) engaged between said tappet member and said opposite end of said piston for transmitting reciprocal movement of said tappet member into equalized and floating reciprocal movement of said piston;

a fuel-intake duct (11) having an intake valve (13) therein and being connected to said pumping chamber for supplying fuel thereto;

a fuel delivery (12) having a delivery valve (14) therein and being connected to said pumping chamber for delivering fuel therefrom, said fuel delivery duct being adapted for connection to a fuel engine injection system for supplying fuel to the fuel engine injection system;

an electric supply pump (15) connected to said fuel intake duct for supplying fuel from a fuel supply tank to the pumping chamber through said intake valve at a variable pressure;

electronic modulation means (17, 18, 19) connected to said electric supply pump for varying the pressure of fuel supplied to said pumping chamber, for varying the bottom dead center position of said piston as it is biased by said biasing means and as a function of pressure in said pumping chamber and before the movement of said piston for executing a stroke for pumping the fuel from said pumping chamber through said delivery valve to said fuel delivery duct; and an electrical pressure sensor (20) connected to said fuel delivery duct for sensing the pressure therein and connected to said electronic modulation means for adjusting the effect of said electronic modulation means on said electric supply pump.

2. A fuel-injection device according to claim 1, wherein said biasing means comprises a thrust spring engaged between said opposite end of said piston and said tappet member for biasing said piston toward said pumping chamber and against the pressure in said pumping chamber.

3. A fuel-injection device according to claim 2, wherein said electronic modulation means comprises a microprocessor connected to said electrical pressure sensor, a power modulation circuit connected to said microprocessor and a motor connected to said power modulation circuit, said motor being connected to said electric supply pump for operating said electric supply pump.

* * * * *